US006405670B1

(12) United States Patent
Desantis

(10) Patent No.: US 6,405,670 B1
(45) Date of Patent: Jun. 18, 2002

(54) BOAT ALIGNMENT DEVICE

(76) Inventor: James Desantis, 534 Banavie Dr., Saint Louis, MO (US) 63137

( * ) Notice: Subject to any disclaimer, the term of this patent is extended or adjusted under 35 U.S.C. 154(b) by 0 days.

(21) Appl. No.: 10/026,507

(22) Filed: Dec. 28, 2001

(51) Int. Cl.[7] ..... B63B 17/00
(52) U.S. Cl. ..... 114/364; 114/219; 114/230.1
(58) Field of Search ..... 114/219, 230.1, 114/231, 230.15–230.19, 221 R, 343, 364; D12/317

(56) References Cited

U.S. PATENT DOCUMENTS

| | | | | |
|---|---|---|---|---|
| 2,456,839 A | | 12/1948 | Princell | |
| 2,706,662 A | | 4/1955 | Brown | |
| 3,019,759 A | | 2/1962 | Woods | |
| 3,064,615 A | | 11/1962 | Waltman | |
| 3,177,838 A | | 4/1965 | Grimes | |
| 3,217,833 A | | 11/1965 | Smith | |
| 4,862,818 A | * | 9/1989 | Sullivan | 114/126 |
| 5,408,946 A | | 4/1995 | Jones et al. | |
| 5,662,060 A | * | 9/1997 | Lemke | 114/219 |
| 5,911,189 A | | 6/1999 | Ryan | |

FOREIGN PATENT DOCUMENTS

| | | |
|---|---|---|
| GB | 2214478 | 6/1989 |

* cited by examiner

*Primary Examiner*—Ed Swinehart
(74) *Attorney, Agent, or Firm*—Stephen R. Greiner

(57) ABSTRACT

A boat alignment device including a clamp for attachment, to a support and a block pivotally attached to the clamp. The block is provided with an aperture of elliptical cross section. A telescoping arm has an outer tubular member of elliptical cross section snugly, yet slidably positioned within the aperture in the block. The telescoping arm also has an inner tubular member of elliptical cross section nested within the outer member and capable of being withdrawn therefrom.

3 Claims, 2 Drawing Sheets

BOAT ALIGNMENT DEVICE

FIELD OF THE INVENTION

The present invention relates generally to ships and, more particularly, to boom-type mooring devices of extensible length.

BACKGROUND OF THE INVENTION

Cruisers, runabouts, and other motorized pleasure boats are typically removed from water after use to increase their longevity. Hoists employing hull-cradling slings have long been the preferred means of accomplishing this task. Unfortunately, centering a boat atop the submerged slings so that the boat is not elevated at an inconvenient list or incline has always been a problem. Most boaters have taken a trial and error approach to solving this problem.

Several attempts are often required to center a boat on hoist slings before it can be lifted from the water. Rough water and strong winds can slow the centering process. Much time and fuel is wasted in repeated attempts to correctly position a boat. If weather conditions are severe, great property loss could be the result of repeated delays in hoisting a boat. A need, therefore, exists for a device that quickly, easily and without guesswork centers a boat in a hoist for lifting from the water.

SUMMARY OF THE INVENTION

In light of the problems associated with the lifting of boats from a body of water for storage, it is a principal object of the invention to provide a device that eliminates guesswork in aligning a boat in a hoist. Use of the device minimizes the risk of damage to both boats and hoists. The device is easy to use and saves time and boat fuel.

It is another object of the invention to provide a device of the type described that that is impervious to corrosion and has a limited number of moving parts. Thus, the device is resistant to fouling by dirt or debris commonly found near bodies of water where boating takes place.

It is a further object of the invention to provide a boat alignment device that can be used with minimal instruction and with no special tools. The device can be adjusted to accommodate boats and hoists of varied dimensions. The device can be configured for compact, out of the way storage when not in use.

It is an object of the invention to provide improved elements and arrangements thereof in a boat alignment device for the purposes described that is lightweight in construction, inexpensive to manufacture, and dependable in use.

Briefly, the alignment device in accordance with this invention achieves the intended objects by featuring a retaining bracket having a block pivotally attached to a clamp. The block has a pair of surfaces that can be selectively engaged with a stop flange on the clamp. A telescoping arm has an outer tubular member of elliptical cross section that is snugly, yet slidably, positioned within an elliptical aperture in the block. An inner tubular member of elliptical cross section is snugly, yet slidably, positioned within the outer member. In use, the elliptical cross section provided to the outer tubular member permits such to be rotated into a tight, binding engagement with the block so that the portion of the outer tubular member projecting from the aperture can be fixed in length. Additionally, the elliptical cross section provided to the inner tubular member permits such to be rotated into a tight, binding engagement with the outer tubular member so that the length of the telescoping arm can be fixed.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 2:
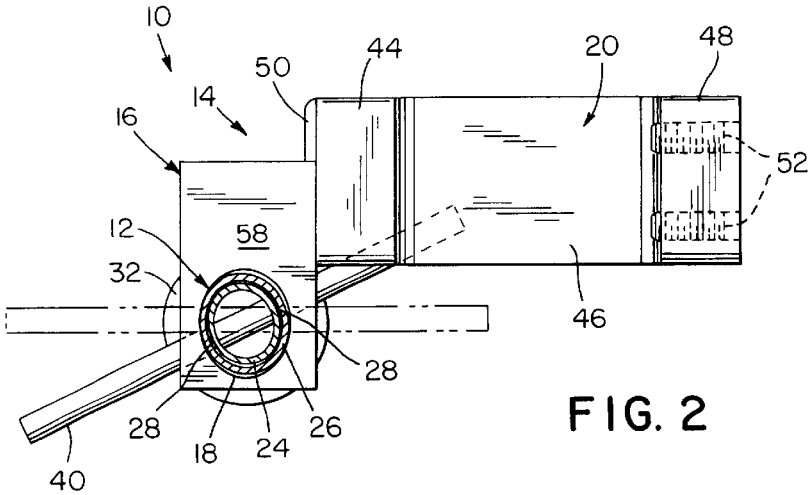
FIG. 2 is a cross-sectional view of the boat alignment device taken along line 2—2 of FIG. 3.
Figure 1:
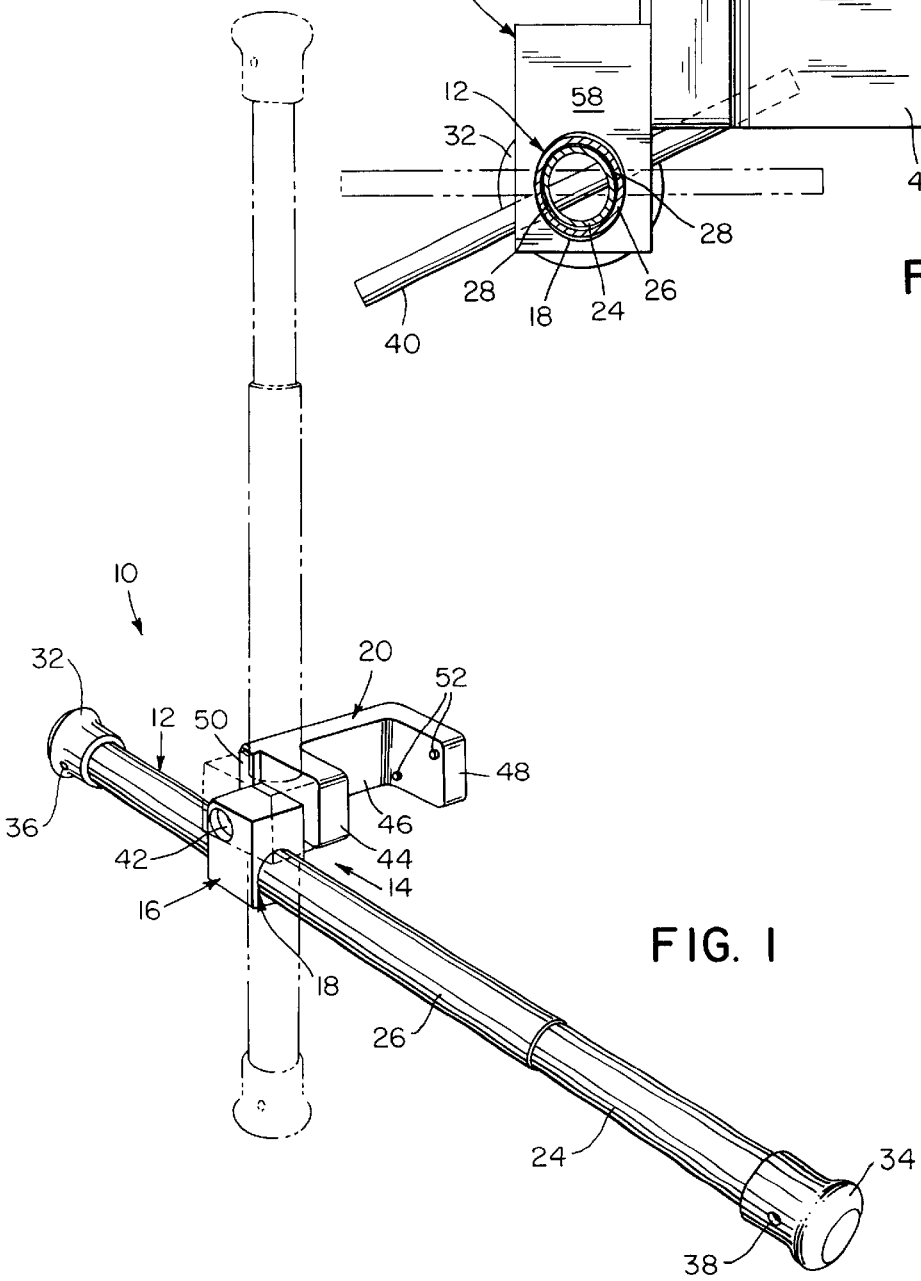
FIG. 1 is a perspective view of a boat alignment device in accordance with the present invention.
Figure 3:
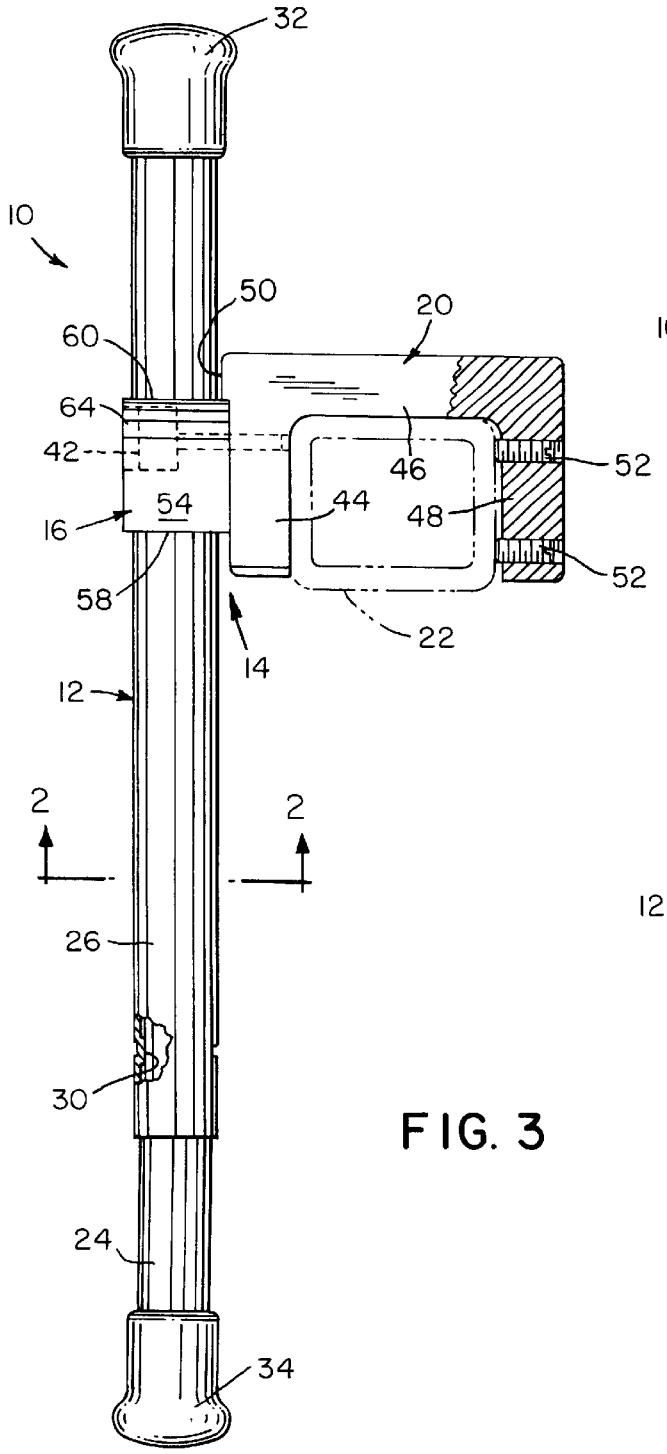
FIG. 3 is a top view of the boat alignment device with portions broken away to reveal details thereof.
Figure 4:
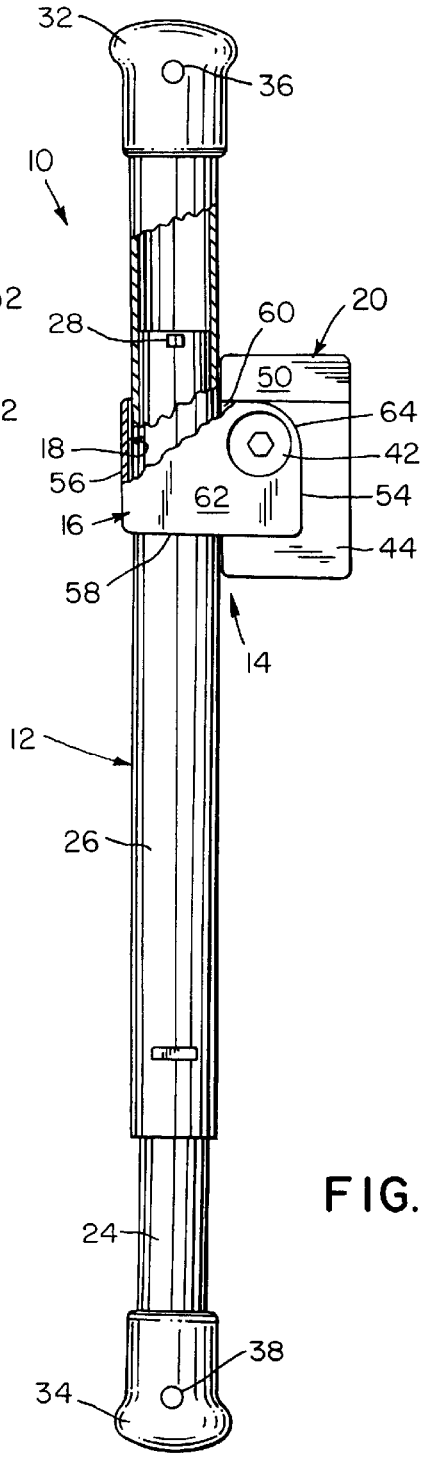
FIG. 4 is a side view of the boat alignment device with portions broken away to reveal details thereof.

Referring now to the FIGS., a boat alignment device in accordance with the present invention is shown at 10. Device 10 includes a telescoping arm 12 slidably attached to a retaining bracket 14. Retaining bracket 14 has a pivot block 16 with an aperture 18 receiving arm 12 and a clamp 20 for firmly attaching device 10 to a support 22. By varying the length and position of arm 12 relative to bracket 14, device 10 can be quickly and easily used to align a boat in a hoist.

Telescoping arm 12 has an inner tubular member 24 nested within an outer tubular member 26 of substantially equal length. With a light pull by a user, tubular member 24 may be partially extracted from the inner end of tubular member 26 to increase the length of arm 12. Complete disconnection of tubular members 24 and 26 is prevented by the engagement of a pair of tabs 28 extending radially outward from the inner end of tubular member 24 with a pair of fins 30 extending radially inward from the inner end of tubular member 26. Preferably, tabs 28 and fins 30 are made by crimping tubular members 24 and 26, formed of a non-corroding metallic alloy along with bracket 14, in a conventional manner.

Tubular members 24 and 26 are provided with elliptical cross sections. (The term "elliptical," as used herein, should be understood to encompass shapes other than true ellipses such as ovals, oblate circular forms, and other geometric shapes with a height greater than width.) Such cross-sectional configurations permit tubular member 24 to be rotated a few degrees into a tight, binding engagement with tubular member 26. Thus, relative rotation of tubular members 24 and 26 permits the length of arm 12 to be fixed by a user.

Tubular member 26 is slidably positioned within aperture 18 in pivot block 16. Aperture 18 is elliptical in cross section to allow tubular member 26 to be rotated into a tight, binding engagement with pivot block 16. In this manner, a user can selectively vary the length of tubular member 26 projecting from either end of pivot block 16.

Rubber end caps 32 and 34 are secured to the opposed ends of telescoping arm 12. Because end caps 32 and 34 have larger diameters than aperture 18, such serve as stops to prevent the detachment of arm 12 from block 16. Of course, end caps 32 and 34 also serve as resilient bumpers for boats and other objects engaging arm 12.

End caps 32 and 34 and the outer ends of tubular members 26 and 24 are penetrated by transverse apertures 36 and 38. A lever 40 may be extended through either of the apertures 36 or 38 to assist in rotating tubular members 26 or 24. It is anticipated that lever 40 will be especially beneficial should arm 12 become wet and difficult to grip during use.

A pivot pin 42 penetrating block 16 at right angles to aperture 18 connects block 16 to a retaining arm 44 of clamp 20. Clamp 20 is preferably U-shaped and includes a crosspiece 46 connecting retaining arm 44 in opposing fashion to a retaining arm 48. A flange 50, coplanar with crosspiece 46, projects outwardly from retaining arm 44. Pivot pin 42 enters retaining arm 44 adjacent to the bottom of flange 50. A pair of set screws 52 penetrates, and is threadably fastened to, retaining arm 48.

Pivot block 16 is generally rectangular in form and is provided with top, bottom, front, back and opposed side surfaces 54, 56, 58, 60 and 62. Preferably, all opposite surfaces are oriented parallel to one another and all adjacent surfaces are oriented at right angles to one another. A curved edge 64, however, joins top surface 54 to back surface 60. Edge 64 is provided with a radius of curvature that permits either top surface 54 or back surface 60 to be pivoted on pin 42 into flush engagement with flange 50. So, bracket 14 provides arm 12 with a ninety degree range of pivotal motion.

Use of device 10 is straightforward. First, clamp 20 is positioned around support 22, an upright of a boat hoist, and is attached to it by rotating set screws 52. (Preferably, clamp 20 is positioned at a height above water level such that arm 12 will both engage a boat and permit easy manipulation by a user within the boat.) Next, with a boat centered in a hoist adjacent device 10 and arm 12 pivoted to horizontal, tubular member 26 is rotated in aperture 18 to lock such within block 16 with its inner end projecting as far as possible from front wall 58. As shown in FIG. 2, lever 40 extended through aperture 36 will move from the horizontal, broken-line position to the solid line position to accomplish this task. Then, if arm 12 must be telescoped further to bring end cap 34 into engagement with the boat, tubular member 24 is withdrawn the needed distance from tubular member 26 and locked in place by rotating it within tubular member 26. Finally, arm 12 is pivoted to a vertical orientation, to permit the boat to move unimpeded from the hoist. Device 10 is set to properly align this boat upon return to the hoist.

To align the boat in the hoist, arm 12 is pivoted downwardly to its horizontal position and into engagement with the boat. The boat is automatically located in a centered position within hoist. The previously submerged slings of the hoist may now elevate the boat. Arm 12 will automatically pivot to a near vertical position as the boat is elevated to prevent damage to the boat or device 10. Should a boat of different dimensions be brought to the hoist, the procedure outlined in the previous paragraph must be followed before boat alignment will be automatically obtained.

Although one device 10 positioned near the midpoint of a boat may be sufficient to align a boat in a hoist, as a practical matter, several devices 10 may be necessary. Obviously, different arrangements of devices 10 are possible depending upon the configurations of the boat and hoist; but, it would be appreciated by any boater that at least three widely spaced devices 10 would be needed to provide optimum, i.e., hands-free, alignment capabilities.

While the invention has been described with a high degree of particularity, it will be appreciated by those skilled in the art that modifications may be made thereto. For example, the number nested tubular members could be increased to provide a telescoping arm of great extended length. Therefore, it is to be understood that the present invention is not limited to the sole embodiment described above, but encompasses any and all embodiments within the scope of the following claims.

I claim:

1. A boat alignment device, comprising:

a retaining bracket including:
- a clamp for attachment to a support; and,
- a block pivotally attached to said clamp, said block being provided with an aperture of elliptical cross section;

a telescoping arm slidably attached to said retaining bracket, said telescoping arm including:
- an outer tubular member of elliptical cross section slidably positioned within said aperture; and,
- an inner tubular member of elliptical cross section nested within said outer member and capable of being withdrawn therefrom.

2. A boat alignment device, comprising:

a retaining bracket including:
- a clamp for attachment to a support, said clamp having a retaining arm from which a flange extends; and,
- a block pivotally attached to said retaining arm adjacent said flange, said block having top and back surfaces that can selectively be engaged with said flange, said block being provided with an aperture of elliptical cross section;

a telescoping arm slidably attached to said retaining bracket, said telescoping arm including:
- an outer tubular member of elliptical cross section snugly, yet slidably positioned within said aperture; and,
- an inner tubular member of elliptical cross section snugly, yet slidably positioned within said outer member and capable of being withdrawn therefrom;
- whereby said elliptical cross section provided to said outer tubular member permits such to be rotated into a tight, binding engagement with said pivot block permitting the length of said outer tubular member projecting from said aperture to be selectively fixed; and,
- whereby said elliptical cross section provided to said inner tubular member permits such to be rotated into a tight, binding engagement with said outer tubular member permitting the length of said telescoping arm to be fixed.

3. A boat aligning device, comprising:

a retaining bracket including:
- a clamp for attachment to a support, said clamp having a retaining arm from which a flange extends; and,
- a block pivotally attached to said retaining arm adjacent said flange, said block having top and back surfaces that can selectively be engaged with said flange, said block being provided with an aperture of elliptical cross section;

a telescoping arm slidably attached to said retaining bracket, said telescoping arm including:
- an outer tubular member of elliptical cross section snugly, yet slidably positioned within said aperture, said outer tubular member having a first transverse aperture for receiving a lever for rotating said outer tubular member; and, an inner tubular member of elliptical cross section snugly, yet slidably positioned within said outer member and capable of being withdrawn therefrom, said inner tubular member having a second transverse aperture for receiving a lever for rotating said inner tubular member;

a pair of end caps secured to the opposed ends of said telescoping arm, said end caps dimensioned to prevent their passage through said aperture in said pivot block.

* * * * *